United States Patent [19]

Gilmore

[11] 3,970,988

[45] July 20, 1976

[54] CONVEYOR-TYPE TRAFFIC SIGNAL DEVICE

[76] Inventor: Ralph W. Gilmore, P.O. Box 426, Brundidge, Ala. 36010

[22] Filed: May 15, 1975

[21] Appl. No.: 577,861

[52] U.S. Cl. ..... 340/43; 40/96; 40/110; 116/63 R; 340/44; 340/373

[51] Int. Cl.[2] ..... G08G 1/00

[58] Field of Search..... 340/43, 44, 41 R, 122, 340/123, 124, 125, 129, 339, 338, 373, 375, 334; 40/32, 96, 110, 117; 116/63 R; 240/10.1, 49, 37.1

[56] References Cited

UNITED STATES PATENTS

| | | | |
|---|---|---|---|
| 1,039,828 | 10/1912 | Siegel | 340/334 |
| 1,765,508 | 6/1930 | Swam | 116/63 R |
| 2,227,613 | 1/1941 | Wells et al. | 340/43 |
| 3,005,186 | 10/1961 | Van Aken | 340/43 |
| 3,408,623 | 10/1968 | Wagner | 340/43 |
| 3,533,062 | 10/1970 | Coffman | 340/43 |
| 3,729,731 | 4/1973 | Konnerth et al. | 340/334 |
| D978,130 | 12/1910 | Barron | 340/334 |

*Primary Examiner*—John W. Caldwell
*Assistant Examiner*—James J. Groody
*Attorney, Agent, or Firm*—Watson, Cole, Grindle & Watson

[57] ABSTRACT

A traffic signal device, capable of being suspended from an overhead support, includes red colored and green colored lamps secured to an endless conveyor mounted about a pair of spaced sprocket wheels so as to effect movement of the lamps from the top to the bottom sprocket in the facing direction. The lamps are spaced on the conveyor so as to be sequentially exposed through an opening of a casing within which the sprockets and conveyor are mounted. Lighted amber traffic lamps are fixedly disposed at the top and bottom of the opening, and the red and green lamps are switched on and remain lighted only while moving downwardly. Stop and Go signs are likewise switched on and remain lighted while the respective red and green lamps are lighted. The motorist may therefore readily observe the time remaining for a llight change from green to red and from red to green.

5 Claims, 5 Drawing Figures

CONVEYOR-TYPE TRAFFIC SIGNAL DEVICE

BACKGROUND OF THE INVENTION

1. Field of the Invention

This invention relates generally to a traffic signal device, and more particularly to such a device allowing the motorist to readily observe the time remaining for a traffic light change.

2. Description of the Prior Art

The standard electronically operated traffic signals in widespread use today alternatively display red and green lights for defining the intervals during which traffic may proceed or may not proceed. The drawbacks with the use of such signal devices include their failure to indicate the interval of time that a given light has before changing from red to green and from green to amber to red or from green directly to red. It is therefore impossible for both motorists and pedestrians to determine whether it would be safe, for example, to proceed even with the green light showing. Moreover, color blind persons cannot clearly discern between the red colored and the green colored traffic lights unless such lights are disposed in a particular location on the traffic signal device uniformly for the various intersections throughout the country. Otherwise, the words "Stop" and "Go" need to be imprinted on the respective red and green traffic lights themselves, or need to be mounted on some other portion of the traffic signal device.

U.S. Pat. No. 1,765,508 to SWAM discloses a traffic signal which recognizes the problem in the failure of standard traffic signals to indicate the interval of time that a red or green traffic light has to continue its signaling function. However, an altogether different approach is taken therein. A more cumbersome and complex device as compared of the invention is disclosed by requiring a reversal of movement of an endless conveyor having opaque plates thereon for gradually closing and opening a column through which lights are observed.

SUMMARY OF THE INVENTION

In accordance with the invention, red and green colored traffic lamps are fixed on an endless conveyor and are equally spaced apart thereon. The conveyor is mounted about a pair of spaced sprocket wheels which are movable to effect downward movement of the lamps, as they are viewed, from the upper to the lower sprocket as the lamps move into an opening in a casing in which the sprockets are mounted. The lamps are switched on and remain lighted only during their downward movement so that the viewer may readily discern the time remaining for the light change of each lamp. Stop and Go signs, associated with the respective red and green lamps, are mounted on the casing and are lighted at the same time as their corresponding lamps. Louvers having a white background may be provided between the light lamps for added contrast while viewing the device.

DESCRIPTION OF THE PREFERRED EMBODIMENT

Figure 1:
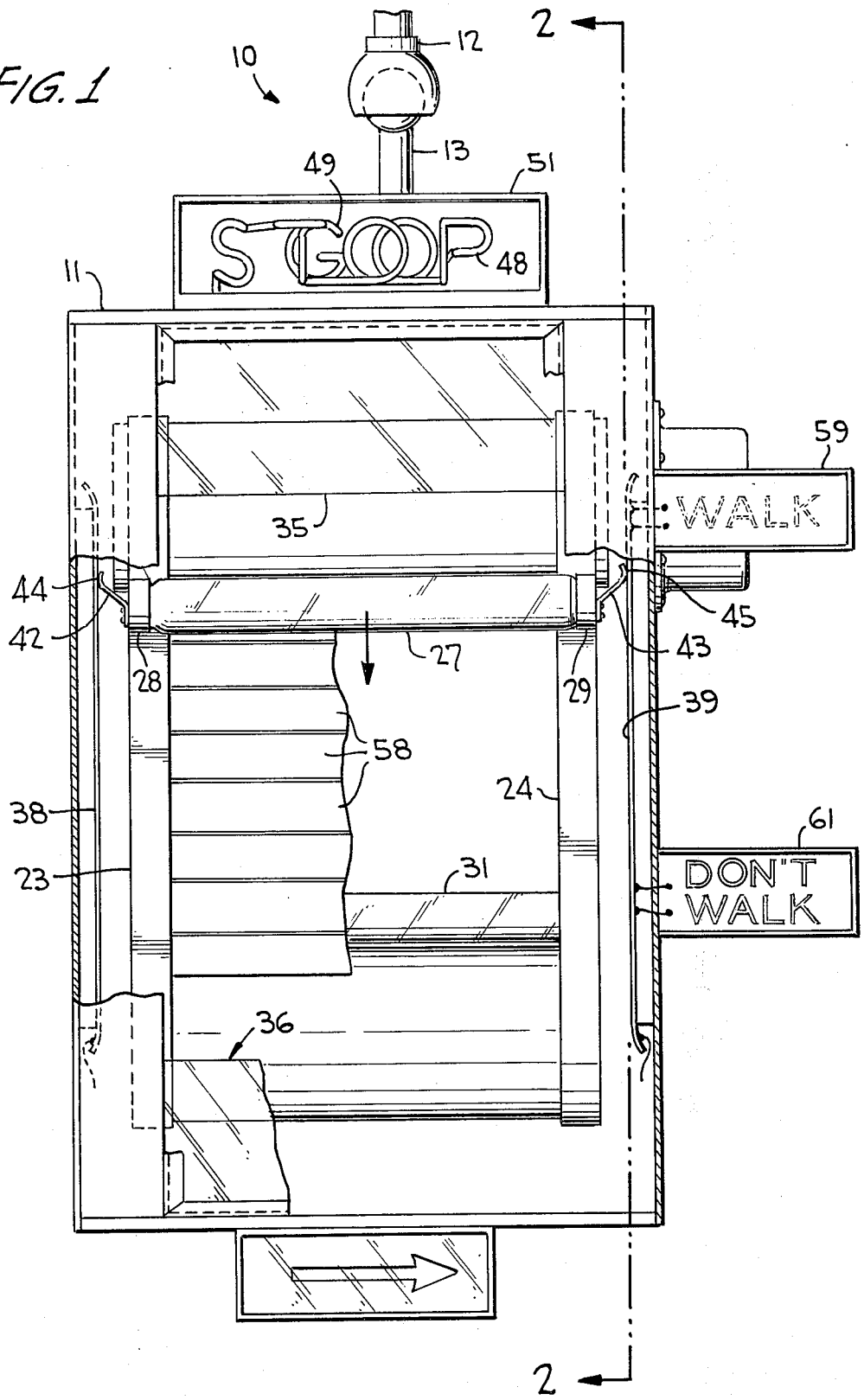
FIG. 1 is a front elevational view of the traffic signal device of the invention with portions thereof broken away for clarity.
Figure 2:
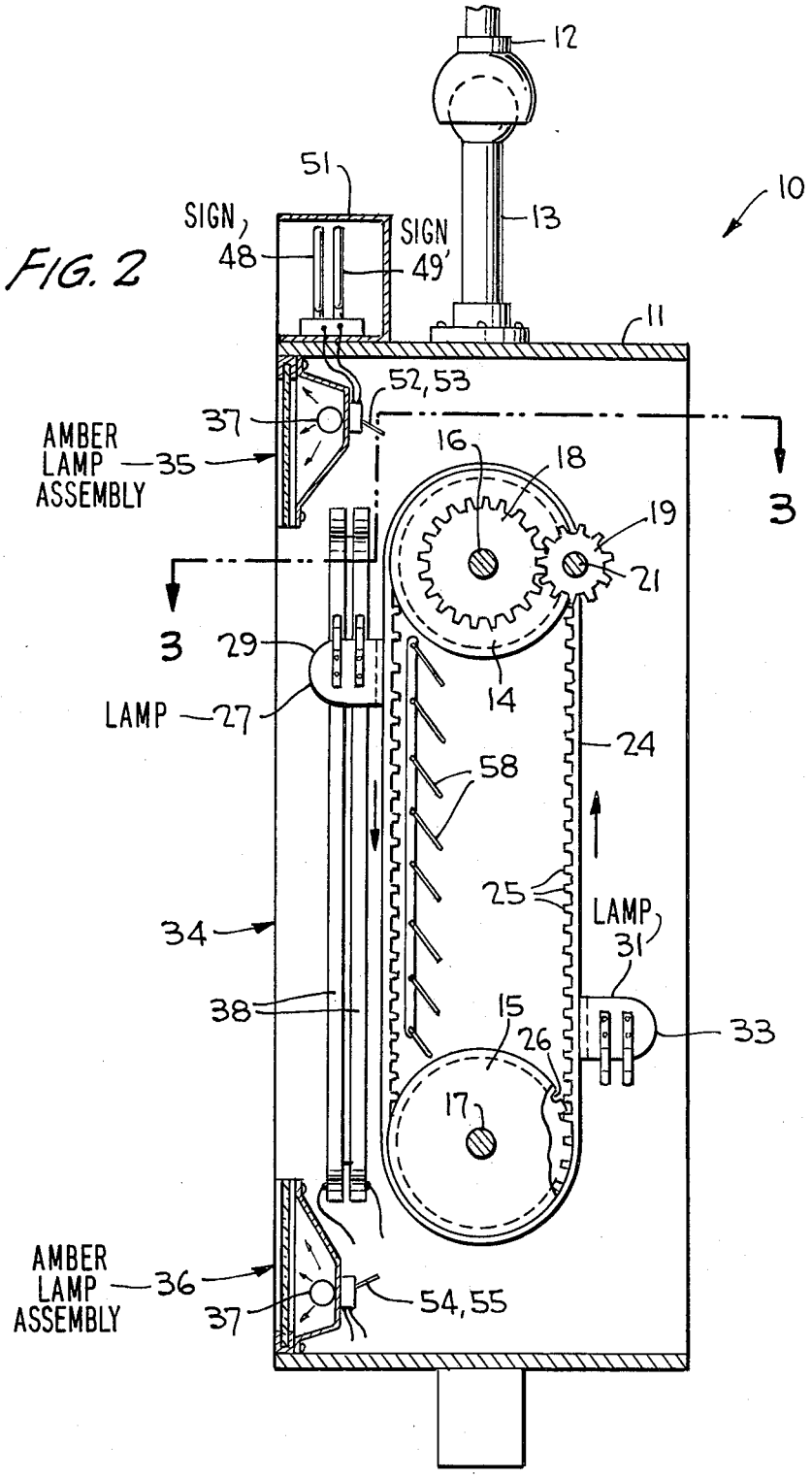
FIG. 2 is a sectional view in side elevation taken substantially along line 2—2 of FIG. 1.
Figure 3:
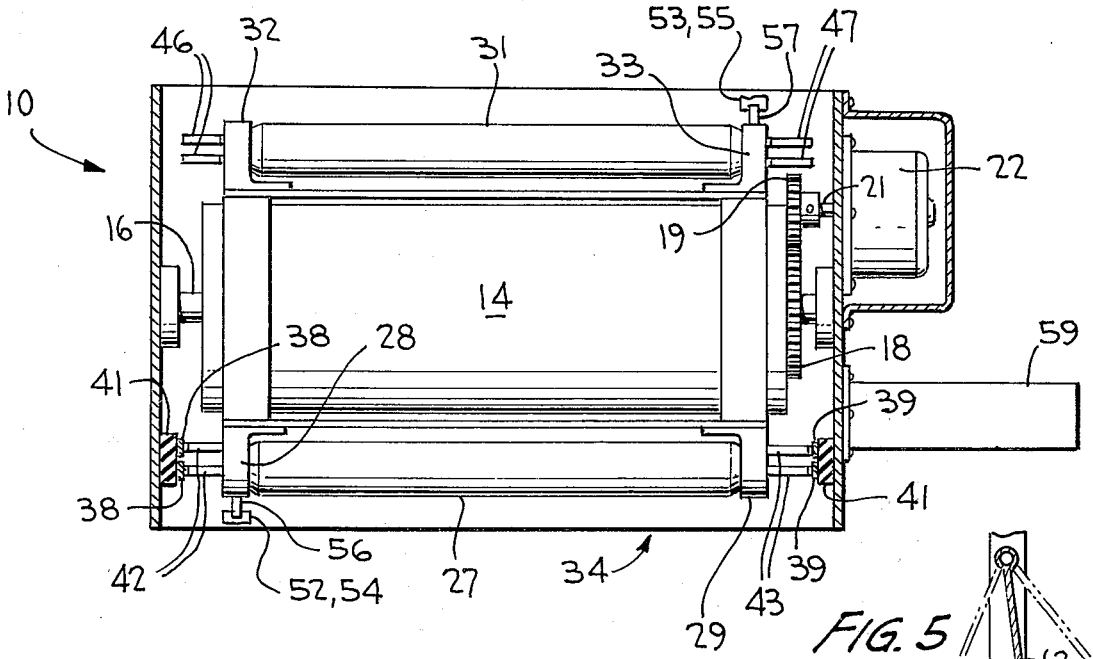
FIG. 3 is a sectional view in top plan of the device taken substantially along line 3—3 of FIG. 2.

Turning now to the drawings wherein like reference characters refer to black and corresponding parts throughout several views, a first embodiment of the traffic signal device is shown generally at 10 in FIGS. 1 to 3. The device includes a box-like casing 11 capable of being suspended from an overhead support 12 by means of, for example, a ball and socket joint between the support and a rod 13 mounted on the casing.

Upper and lower sprocket wheels 14 and 15 are mounted within the casing for rotation about their respective horizontal axles 16 and 17. One of the sprockets, such as upper sprocket 14, has a gear wheel 18 mounted thereon in toothed engagement with a gear reduction wheel 19 provided on motor shaft 21 which is rotated in any normal manner as by means of an electric motor 22. (See FIG. 3).

A pair of horizontally spaced conveyor belts 23 and 24 are mounted about the sprockets, each of the belts having spaced teeth 25 for engagement with grooves 26 of the sprocket wheels so as to effect movement of the conveyor belt upon rotation of the wheels. Of course, the particular tooth and groove arrangement shown may be reversed between the belts and sprockets, or any other known means may be provided for avoiding slippage between the sprockets and the belts.

A lamp 27, which may be an elongated red colored fluorescent or neon lamp, is mounted in any normal manner on the outer surfaces of the conveyor belts parallel to the horizontal axles of the sprocket wheels and between end socket plates 28, 29 thereof. Similarly, a lamp 31, which may be a green colored elongated fluorescent or neon lamp, is mounted on the outer surfaces of the belts at equal distances from both sides of lamp 27. This lamp 31 is also disposed parallel to the horizontal axles of the sprockets and is mounted by means of its end socket plates 32, 33.

As clearly seen in FIGS. 2 and 3, the casing has an opening 34 at its front side through which the lighted lamps 27 and 31 may be viewed as to be more fully described hereinafter. The upper and lower edges of this opening are defined by amber lamp assemblies 35 and 36 fixedly mounted on the casing and each having an amber lamp 37 therein which may be a neon or fluorescent elongated lamp electrically connected in any normal manner through an electric circuit to a power source (not shown). Amber lamps 37 are designed to be in a lighted condition at all times during operation of the present traffic signal device.

The present device is also designed so that lamps 27 and 31 are switched on and remain lighted while they respectively move downwardly within opening 34 of the casing from the upper to the lower brackets. Accordingly, pairs of elongated, electrically conducting elements 38 and 39 are respectively mounted on opposite side walls of the casing as by means of insulating pads 41. Also, pairs of electric contact elements 42 and 43 are provided on end plates 28 and 29 of lamp 27 and are interconnected in any normal manner within the lamp socket. These contact elements have upwardly bent ends 44 and 45 and are slightly spring-biased into sliding contact with their respective elongated contact elements as shown in FIGS. 1 to 3. The elongated contacts are, of course, electrically connected to the electric power source through suitable electric circuit means in any normal manner. Likewise, contact elements 46 and 47 are provided on their respective end plates 32 and 33 for lamp 31 and are identical in all respects to those contact elements described for lamp 27. Accordingly, during rotation of the sprocket wheels and the corresponding movement of the conveyor belt in the direction of the arrow shown in FIGS. 1 and 2, lamp 27 will be switched on as its contact elements contact elongated elements 38 and 39 at the upper ends thereof. FIGS. 1 and 2 show the position of lamp 27 after having moved downwardly following initial contact with elements 38 and 39. Lamp 27 remains lighted until it moves sufficiently downwardly and away from the elongated contact elements whereupon its contact elements 42 and 43 move out of contact therewith. Lamp 27 is thereupon turned off and the green lamp 31 is subsequently switched on when its contact elements 46 and 47 make contact with elements 38 and 39 similarly as that described for lamp 27. Accordingly, lamp 31 remains lighted until it moved sufficiently downwardly and away from elongated contacts 38 and 39.

Signs 48 and 49 exhibiting the words "Stop" and "Go", which may both be neon signs, are mounted on the casing within a front open cover 51 in any normal manner. Both signs are electrically connected to the electric power source through the same electric circuit means provided for the other lamps of the device. Toggle switches 52, 53 are respectively associated with these Stop and Go signs for switching them on. Likewise, similar toggle switches 54 and 55 are provided at the lower end of the red and green lamp run for switching signs 48 and 49 off. Such switching is effected by means of a switch finger 56 provided on end plate 28 and a switch finger 57 provided on end plate 33. As seen in FIG. 3, toggle switches 52 and 54 are vertically superimposed with switch 52 being an "on" switch for sign 48 and switch 54 being an "off" switch for that sign. Similarly, toggle switches 53 and 55 are vertically superimposed, with switch 53 being an "on" switch for sign 49 and switch 55 being an "off" switch for that sign. Accordingly, at the time lamp 27 approaches the upper ends of elongated contacts 38 and 39, and at the time initial contact therewith is made, finger 56 bears against toggle switch 52 for turning on stop sign 48 so that the word "Stop" can be read by the viewer while the red lamp 27 is lighted throughout its downward movement. And, at the time light 27 moves away from contacts 38 and 39, its finger 56 simply bears against switch 54 for opening the electrical circuit to turn off stop sign 48. Go sign 49 is turned on and off in a similar manner by finger 57 of lamp 31.

In order to provide a contrasting background for the lamps as they are viewed while lighted, an assembly of louvers 58 is mounted to the casing behind the downwardly moving lamps. These louvers are pivotally secured in place along their upper edges so as to be capable of freely swinging inwardly and outwardly of their support so as not to provide any resistance against the forces of wind blowing against the device. Also, the surfaces of the louvers facing the downwardly moving lamps and the viewer may be of a white or otherwise light color so as to provide an effective contrasting background for the downwardly moving lamps.

Walk and Don't Walk signs 59 and 61 may be mounted on casing 11 and operatively interconnected with the electric circuit means so as to be turned on and off in a manner similar to that described for signs 48 and 49.

Figure 5:
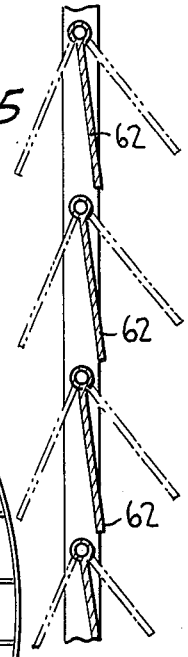
FIG. 5 is a sectional view taken substantially along line 5—5 of FIG. 4.
Figure 4:
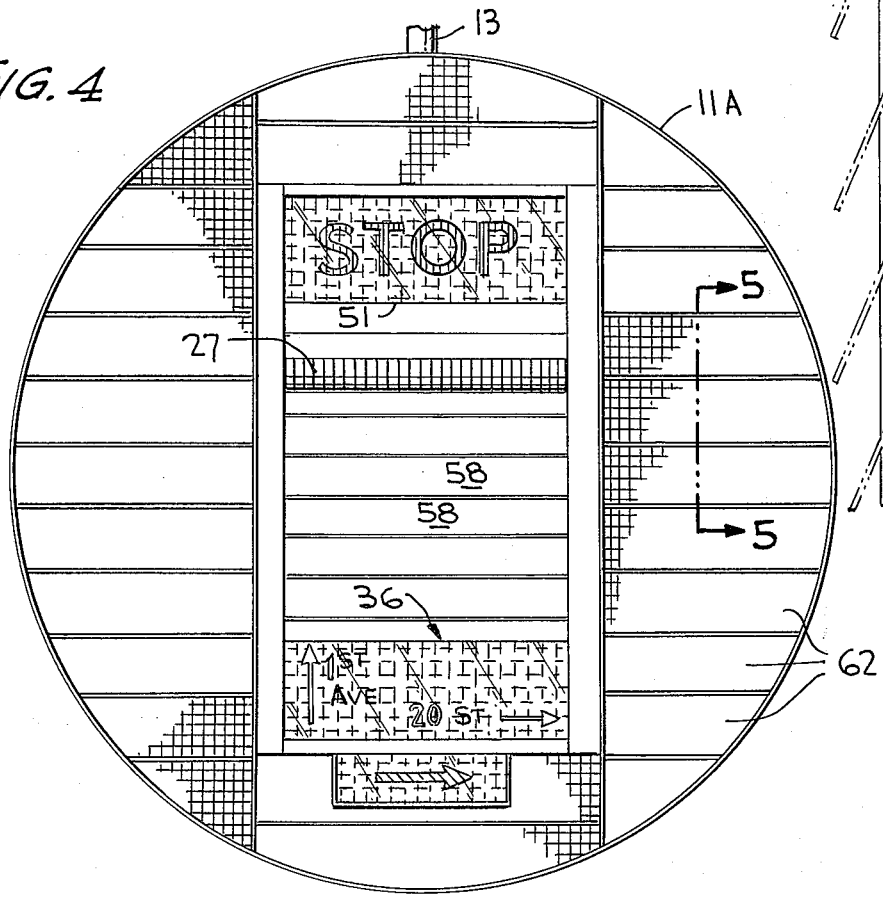
FIG. 4 is a front elevational view of another embodiment of the signal device of the invention.

FIG. 4 shows another embodiment in accordance with the invention wherein casing 11 has a cylindrical wall 11A, and only a cover 51 for the Stop and Go signs 48 and 49 is provided at the top of the casing opening through which downwardly moving lamps 27 and 31 are viewed. Also, lamp assembly 36 may be provided with street direction information thereon. Moreover, an assembly of additional louvers 62 close the remainder of the open end of casing 11A not occupied by the present traffic control device. The surfaces of these louvers as viewed in FIG. 4 may be blackened or otherwise darkened so as to provide a background contrast with the lighted frontal surfaces of louvers 58. Also, louvers 62 are mounted in place for pivotal movement in opposite directions as shown in phantom outline in FIG. 5, so as to provide no resistance to the forces of the wind blowing against the present device.

From the foregoing it can be seen that a simple and economical, yet highly effective traffic signal device is provided to permit both the motorist and the pedestrian to readily observe the interval remaining for a light change. Moreover, colorblind persons may easily and distinctly differentiate between the downwardly moving red and green lamps since corresponding Stop and Go signs are lighted at the same time.

Obviously, many modifications and variations are made possible in the light of the above teachings. It is therefore to be understood that within the scope of the appended claims the invention may be practiced otherwise as specifically described.

What is claimed is:

1. A traffic signal device capable of being suspended from an overhead support, comprising:

a casing having an opening at a front side thereof;

upper and lower vertically spaced sprocket wheels mounted in said casing for rotation about horizontal axes;

an endless belt mounted about said sprocket wheels for movement during rotation thereof;

a red colored and a green colored traffic lamp fixedly mounted on said belt;

said lamps being disposed on said belt at equal distances apart;

an amber lighted traffic lamp fixedly mounted on said casing above and adjacent said upper sprocket wheel, and another amber lighted traffic lamp fixedly mounted on said casing below and adjacent said lower sprocket wheel, said amber traffic lamps facing toward said front side of said casing and respectively defining upper and lower edges of said front side;

electrical, elongated contact elements on said front side of said casing extending vertically between and slightly outwardly of the horizontal axes of said sprocket wheels;

electric circuit means, said contact elements being connected to said means; and electric contact elements on each of said red colored and green colored lamps respectively disposed for contacting engagement with said elongated contact elements;

whereby said red colored and green colored lamps are respectively lighted only upon downward movement between said sprocket wheels when their said contact elements are in contact with said elongated contact elements thereby permitting a viewer to readily observe the time remaining for a traffic light change.

2. The traffic signal device according to claim 1, wherein an assembly of louvers is mounted on said casing between said sprocket wheels and inwardly of said elongated contact elements, said louvers being pivotally secured along one side thereof to said assembly for free pivotal movement between open and closed positions.

3. The traffic signal device according to claim 1, wherein Stop and Go exhibiting signs are mounted on said casing, said signs being electrically connected with said circuit means, a pair of electrical switches on said casing respectively associated with said signs, and switch operating means on said red colored and green colored lamps for closing and opening said circuit to said signs respectively at the start and end of contact of said red colored and green colored lamps with said elongated contact elements.

4. The traffic signal device according to claim 1, wherein said casing has an outer cylindrical wall and said front side is flat, said opening occupying a portion of said front side with the remainder thereof being occupied by additional louvers capable of freely opening and closing.

5. The traffic signal device according to claim 1, wherein said red colored and green colored lamps comprise elongated neon lamps having said contact elements at opposite ends thereof.

* * * * *